US012085069B1

(12) United States Patent
Dreher

(10) Patent No.: US 12,085,069 B1
(45) Date of Patent: Sep. 10, 2024

(54) FOR CPA PUMPING UNIT WITH END RETURN FOR POSITIONING DRIVE

(71) Applicant: George R Dreher, Midland, TX (US)

(72) Inventor: George Dreher, Midland, TX (US)

( * ) Notice: Subject to any disclaimer, the term of this patent is extended or adjusted under 35 U.S.C. 154(b) by 0 days.

(21) Appl. No.: 17/512,541

(22) Filed: Oct. 27, 2021

Related U.S. Application Data

(63) Continuation of application No. 17/140,031, filed on Jan. 1, 2021, now Pat. No. 11,204,028.

(51) Int. Cl.
*F04B 47/02* (2006.01)
*E21B 43/12* (2006.01)

(52) U.S. Cl.
CPC ..... *F04B 47/022* (2013.01); *E21B 43/127* (2013.01); *F04B 47/028* (2013.01)

(58) Field of Classification Search
None
See application file for complete search history.

(56) References Cited

U.S. PATENT DOCUMENTS 2,432,735 A * 12/1947 Downing ..... F04B 47/04 417/904
2,915,919 A * 12/1959 Mitchell ..... G01M 1/36 74/41
2,940,335 A * 6/1960 Mitchell ..... F04B 47/14 74/41
2,958,237 A * 11/1960 Johnson ..... F16H 21/42 74/41
2,995,048 A * 8/1961 Mitchell ..... F16F 15/28 74/590
3,175,513 A * 3/1965 Dulaney ..... F04B 47/04 417/399
3,192,797 A * 7/1965 Patterson ..... F16F 15/261 74/591
3,209,605 A * 10/1965 Scoggins, Jr. ..... F04B 47/02 74/591
3,364,755 A * 1/1968 Miller ..... F16H 33/02 74/41
4,377,092 A * 3/1983 Garmong ..... F04B 47/028 74/41
4,505,162 A * 3/1985 Hoh ..... F04B 47/12 74/108

(Continued)

*Primary Examiner* — Essama Omgba
*Assistant Examiner* — Geoffrey S Lee
(74) *Attorney, Agent, or Firm* — Richard Kosakowski

(57) ABSTRACT

There are several methods to propel moving force points on a pumping unit. One of the embodiments is propulsion utilizing permanent magnets. This invention can aid the several methods and provides the push start that allows initiating permanent magnet propulsion.

This invention relates to an end return device for assisting positioning drives to actuate the continuous movement by mechanical means of moving force points to a desired advantageous position at a desired advantageous moment to achieve reduced net torque when lifting or lowering an unbalanced load with a beam with a fulcrum and connected to a load and an effort.

In one embodiment, a walking beam well pumping unit, the lifting and lowering of the well load can be caused by the reciprocating motion of a beam tipping on a fulcrum and with moving effort force point, moving crank shaft force point, and moving beam weight force point.

12 Claims, 6 Drawing Sheets

(56) References Cited

U.S. PATENT DOCUMENTS

| | | | | |
|---|---|---|---|---|
| 4,660,426 | A * | 4/1987 | Mosley | F04B 47/14 74/41 |
| 5,409,356 | A * | 4/1995 | Massie | H02K 41/02 74/110 |
| 6,386,322 | B1 * | 5/2002 | McCormick | E21B 43/127 417/328 |
| 10,107,282 | B1 * | 10/2018 | Dreher | G05B 19/402 |
| 10,202,973 | B1 * | 2/2019 | Dreher | G05B 19/406 |
| 10,340,755 | B1 * | 7/2019 | Dreher | H02K 7/1807 |
| 10,577,904 | B1 * | 3/2020 | Dreher | E21B 43/127 |
| 10,605,240 | B2 * | 3/2020 | Becker | F04B 47/14 |
| 10,995,744 | B1 * | 5/2021 | Dreher | E21B 43/127 |
| 11,060,517 | B1 * | 7/2021 | Dreher | F16H 21/22 |
| 11,204,028 | B1 * | 12/2021 | Dreher | F04B 49/20 |
| 2017/0292353 | A1 * | 10/2017 | Liu | E21B 47/009 |

* cited by examiner

FOR CPA PUMPING UNIT WITH END RETURN FOR POSITIONING DRIVE

CROSS-REFERENCE TO RELATED APPLICATIONS

This is a continuation of application Ser. No. 17/140,031, filed Jan. 1, 2021, allowed Sep. 13, 2021, now U.S. Pat. No. 11,204,024 granted Dec. 21, 2021.

This application claims priority to and the benefit of the filing of U.S. Provisional Patent Application No. 62/411,556, filed on Oct. 22, 2016; U.S. Provisional Patent Application No. 62/403,165, filed on Oct. 2, 2016; U.S. Provisional Patent Application No. 62/421,410, filed on Nov. 14, 2016; U.S. Provisional Patent Application Ser. No. 62/426,337, filed on Nov. 25, 2016; U.S. Provisional Patent Application Ser. No. 62/535,846, filed on Jul. 22, 2017; U.S. Provisional Patent Application Ser. No. 62/535,945, filed on Jul. 23, 2017; and U.S. Non-Provisional patent application Ser. No. 15/719,964, filed on Sep. 29, 2017; U.S. Non-Provisional patent application Ser. No. 15/789,760, filed on Oct. 20, 2017; U.S. Non-Provisional patent application Ser. No. 15/810,083, filed on Nov. 12, 2017; U.S. Non-Provisional patent application Ser. No. 16/130,068, filed on Sep. 13, 2018; Non-Provisional patent application Ser. No. 16/709,679, filed on Dec. 10, 2019; Non-Provisional patent application Ser. No. 16/709,815, filed on Dec. 10, 2019; Non-Provisional patent application Ser. No. 17/100,908, filed on Nov. 22, 2020; Non-Provisional patent application Ser. No. 17/107,821 filed on Nov. 30, 2020; Non-Provisional patent application Ser. No. 17/127,626 filed on Dec. 18, 2020; and the specifications and claims (if any) thereof are incorporated herein by reference.

BACKGROUND OF THE INVENTION

Field of the Invention (Technical Field)

Embodiments of the present invention relate generally to improved efficiency for lifting and lowering unbalanced loads.

Description of Related Art

Lifting and lowering of loads has often been facilitated with the use of counterweight (counterbalance) to offset the load, in a manner to reduce the required force to raise and lower the load with the counterweight to be in some state of balance. Whether as in the intentionally unbalanced state, for example, in the Trebuchet beam, a fulcrum machine where a counterweight heavier than the load causes a beam with a fulcrum point to hurl a missile projectile from the opposite lighter beam end when the much heavier counterweight end drops; or in intentionally balanced modes, for example, an elevator, or a beam well pumping unit, often referred to as a "pump jack", the term "net force" or other synonyms can be used to describe a quantity of positive or negative force required to raise or lower a load after factoring in an attempt to balance or unbalance with counterweight in order to lighten or increase the load. "Gross torque" and other synonyms can be used to describe a quantity of torque required to raise or lower a load without or before an attempt to balance or unbalance with a counterweight—for example, a weight lifting exercise machine whose very purpose is to be heavy.

Gravity is the natural force being countered with the machine's counterbalance force, so with a fixed amount of load and fixed amount of counterweight the machine's required force is relatively constant. Some designs have attempted to improve lifting efficiency in various ways: by varying the angles of pull in the pulling machine, varying the length of linkages in the pulling machine, varying the size of pulleys in the pulling machine, and/or varying the speed reduction of pull in the pulling machine. In the case of beam pumping units which raise and lower a more or less vertical load there is a tipping (fulcrum) point and counterweight effort and load is intended to be in a close state of balance.

Machines designed to do heavy lifting are big and expensive and repairs on worn parts are expensive. The less force that is needed to accomplish the desired work, the smaller the machine components can be, and the less energy can be consumed accomplishing the work, and the less wear and tear on the machine occurs, and all this results in less expense to operate the machine, so designers have tried force-reducing designs in order to improve the economics of the lifting work.

Now we describe some design attempts to reduce the required lifting forces that are variations of both adjustable crank weight and beam weight "conventional" center tipping (fulcrum point) class 1 lever geometry and class 3 lever geometry (rear tipping-fulcrum point) that have attempted to reduce required counterweight in beam well pumping which in operation converts rotary motion of the prime mover, speed reducer, and crank arms, to vertical reciprocating motion of the pitman arms connected to the beam in order to facilitate rod pumping. Besides conventional class 1 geometry these variations can be front-mounted with rear fulcrum points as a class 3 lever, as in the first 1920s air balance units which still use air cylinder pressure as counterweight, and Parkersburg's "Monkey Motion" with fourteen bearing points which was entirely beam weighted with no crank arm weights which made the larger size beam weights bulky. However, both these designs allow more constant effective counterbalance than crank weighted with rotary motion counterweights as used in the 1930s "grasshopper" (Mark II) with class 3 rear fulcrum.

Deeper wells required more counterweight so massive units came of age in the early 1970s when the first sales order for the Mark II 1280 for Union Oil well in Farnsworth, Texas, was obtained by E. L. Hudson which started the era of massive crank weight pumping units when the Mark II's inventor Walter Trout instructed his engineer Joe Byrd to further refine the grasshopper design to accept the largest phased crank counterweight unit ever, and so came the first Mark II 1280.

One problem is that in beam pumped wells the lifted weight is about 1.5 times the weight of the lowered weight due to lifting the weight of the fluid plus the buoyant weight of the sucker rods in the pipe when lifting, but the fluid weight is then held by the downhole pump standing valve when lowered making lifting and lowering unbalanced, so in known references, the difference in counterweight required is split on the up stroke and down stroke which leaves significant unresolved net torque due to the unsolved unbalanced downhole condition.

With conventional beam units, massive effective counterweight is achieved with leverage of adjustable crank weight. But purely beam weighted units were built by Parkersburg and Cabot and others because the effective beam weight is direct and is more constant than rotary crank weight.

A phased crank design for conventional beam unit with class 1 lever center fulcrum point was published by George Eyler and Cabot Corporation in 1963. And an advanced geometry design was published by Bob Gault and Bethlehem Supply in 1965. These design elements require operating the unit in one direction only and mainly address effective counterweight applied to torque factor, which is a crank angle based multiplier from unit geometry that affects torque calculation at the speed reducer, and sometimes is able to reduce torque over "conventional" designs.

But, the air balance design can reverse direction and the gear teeth in the speed reducer are known for long life. This is partly because with easily adjusted air pressure the counterweight balance is easily maintained close to equal on upstroke and downstroke.

In 1984, Sam Gibbs introduced a wave equation that allowed well controllers to shut off pumping units when fluid in the well bore was low. Thus, variable frequency drives were introduced to seek better efficiency by slowing the pumping units or shutting them off when fluid in the well bore was low. This has led to many other intelligent controllers including speed controllers and soft reversing mechanisms.

All the designs mentioned can achieve a fairly limited increase in efficiency but still leave the problem of downhole unbalanced weight between lifting and lowering. So, there's much room for improvement—including the need for much greater efficiency regarding reduction of torque and net torque, in order to achieve longer lasting components, and reduced operating expense, reduced power consumption, longer stroke lengths and smaller speed reducers.

Some noteworthy patents:

| U.S. Pat. No. | Date | Inventor | Class |
|---|---|---|---|
| 1,895,181 | Jan. 23, 1933 | W. C. TROUT | |
| 2,134,326 | Oct. 25, 1938 | R. G. DE LA MATER | 74-41 |
| 2,155,174 | Apr. 18, 1939 | W. C. TROUT | 74-591 |
| 2,179,649 | May 4, 1939 | W. C. TROUT ET AL | 74-41 |
| 2,210,661 | Sep. 6, 1940 | J. L. FINCHER/LUFKIN | 74-593 |
| 2,213,646 | Sep. 30, 1940 | A. M. BUTCHER | |
| 2,232,245 | Feb. 25, 1941 | R. G. DELAMATER | 74-539 |
| 2,293,915 | Sep. 25, 1942 | E. W. PATTERSON | 74-589 |
| 2,915,919 | Dec. 8, 1959 | C. C. MITCHELL | 74-590 |
| 3,310,988 | Mar. 28, 1967 | R. H. GAULT | 74-41 |
| 3,406,581 | Oct. 22, 1968 | G. EYLER | 74-41 |
| 4,490,094 | Dec. 25, 1984 | S. G. GIBBS | 417/42, 417/22X, 417/53X, 22-24 |

BRIEF SUMMARY OF EMBODIMENTS OF THE PRESENT INVENTION

Statement of problem solved: There are several methods to propel moving force points on a pumping unit. One of the embodiments is propulsion utilizing permanent magnets. This invention can aid the several methods and provides the push start that allows initiating permanent magnet propulsion by solving "cogging".

Embodiments of the present invention relate to lifting and lowering loads more efficiently and also more economically than known systems. This invention relates to an end return device for assisting positioning drives to actuate the continuous movement by mechanical means of moving force points to a desired advantageous position at a desired advantageous moment to achieve reduced net torque when lifting or lowering an unbalanced load with a beam with a fulcrum and connected to a load and an effort.

In one embodiment, a walking beam well pumping unit, the lifting and lowering of the well load can be caused by the reciprocating motion of a beam tipping on a fulcrum and with moving effort force point, moving crank shaft force point, and moving beam weight force point.

Potentially reduced net torque might allow longer life speed reducers, smaller speed reducers, and longer reciprocating vertical stroke length and these are both economic and performance benefits.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention.

All the drawing figures with the elements are included intending to facilitate teaching those skilled in the art how to build an "end return device" that is an end-of-motion-start-of-motion-return-device to assist terminus-turn-around, disposed on a beam pumping unit member connected to a speed reducer (crank pin force point), or a tail bearing (effort force point), or a walking beam (moving beam counterweight) for providing a means for starting and stopping a drive mechanism that positions the movement of at least one of an effort force point and a crank pin force point and a beam counterweight moving in real time.

In the drawings:

Figure 1:
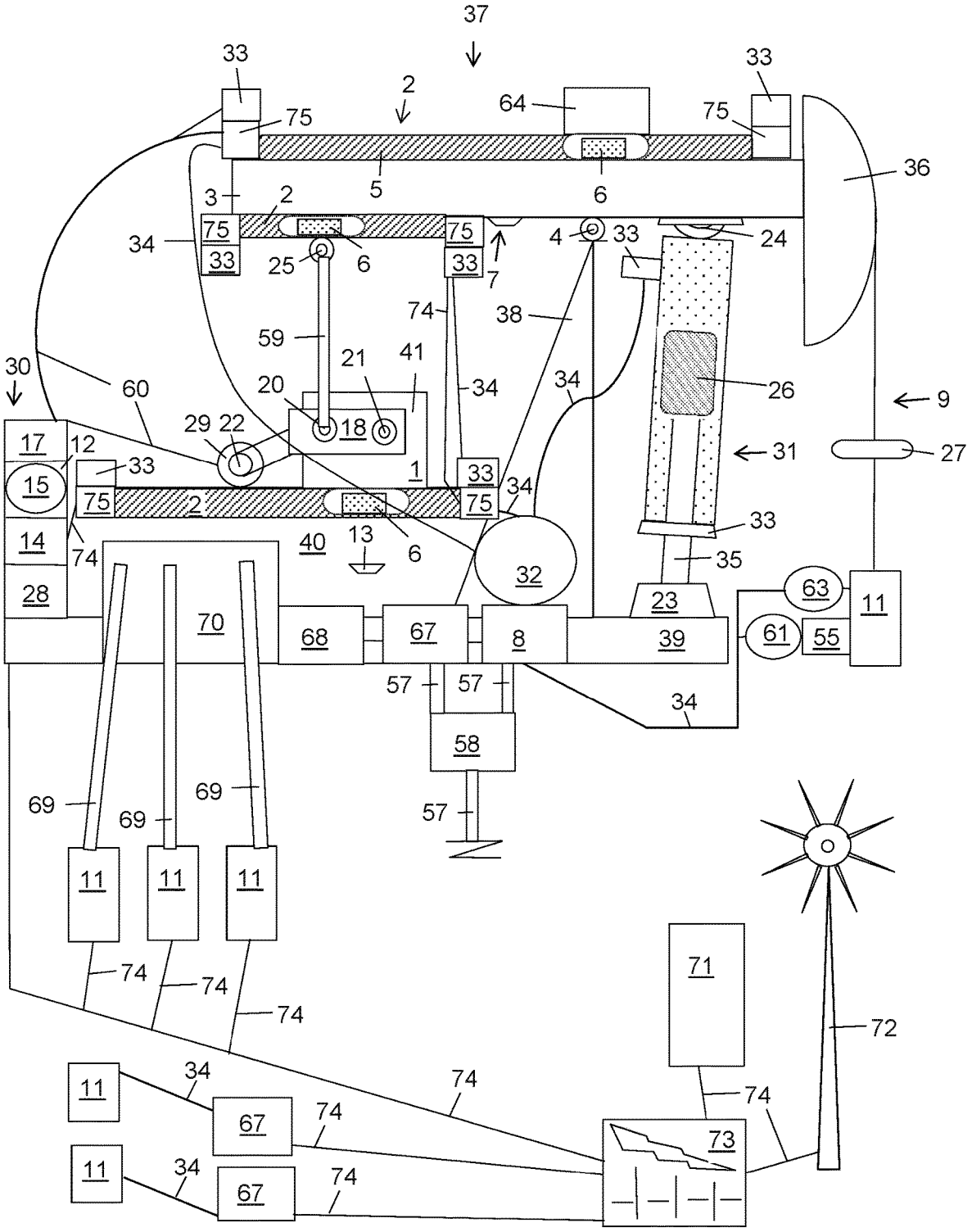

FIG. 1, one embodiment illustrating an end return device for assisting a pumping unit with positioning drive and three moving force points: moving effort, moving crank shaft, and moving beam weight; with beam air compressor Also system controller, with multi-well manifold for electricity generator, air compressor or hydraulic pump, and renewable energy as both solar panels and wind turbine, plus grid storage or battery storage.

Figure 2:
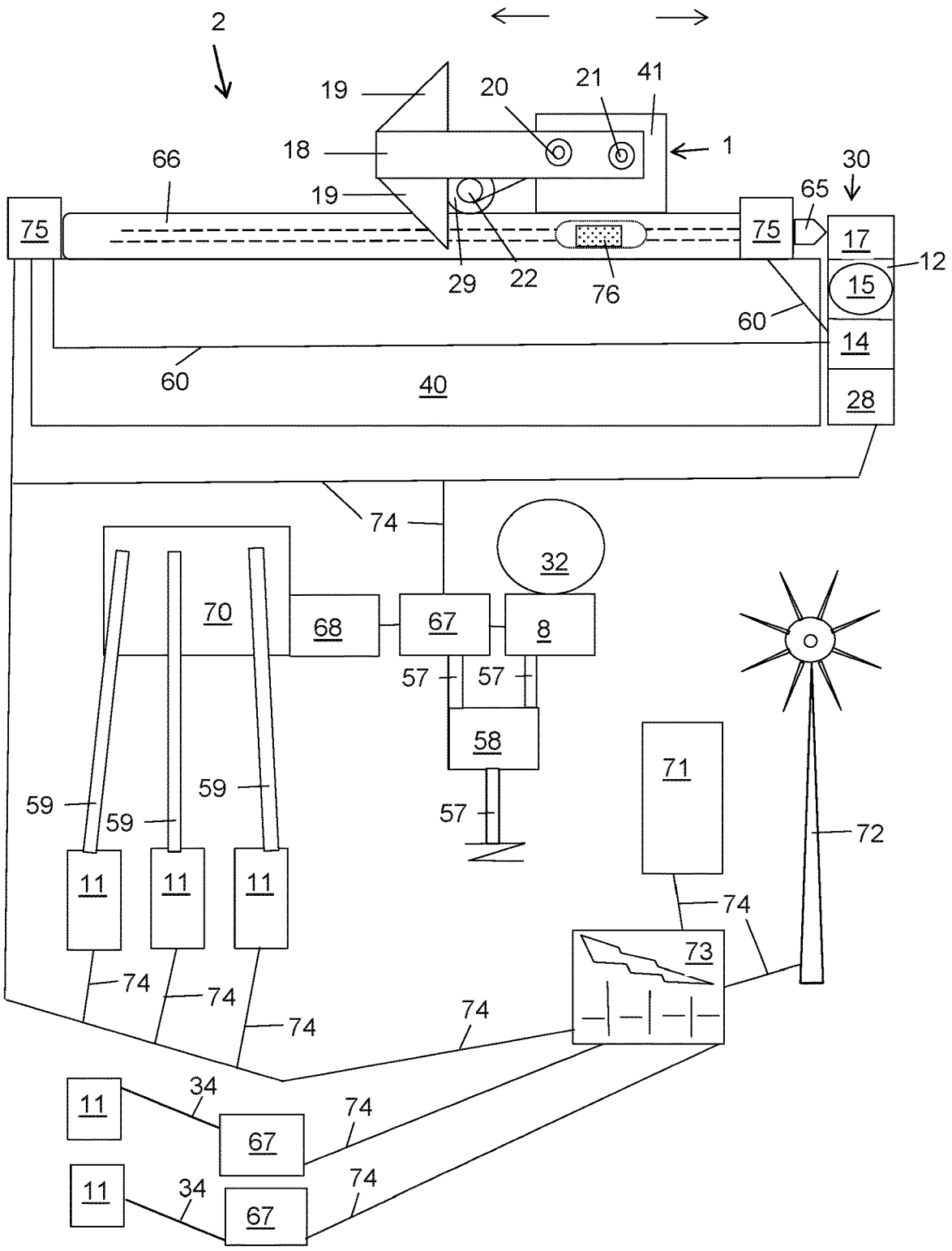

FIG. 2, one embodiment illustrating an end return device for assisting a positioning drive for moving force point with linear motor actuator.

Figure 3:
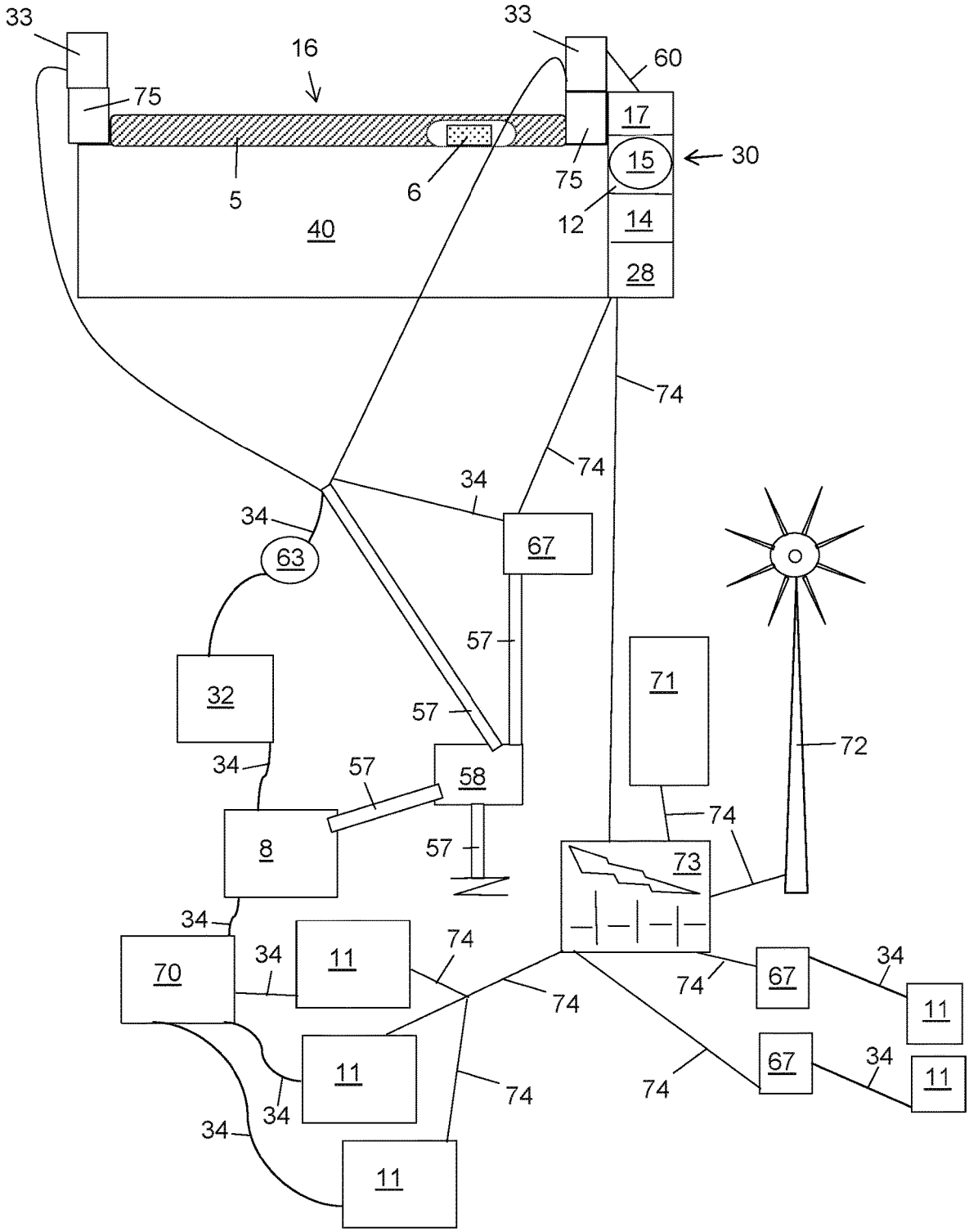

FIG. 3, one embodiment illustrating an end return device for assisting a positioning drive for moving force point with single-acting or. double acting rodless cylinder, illustrates hook-up and system controller.

Figure 4:
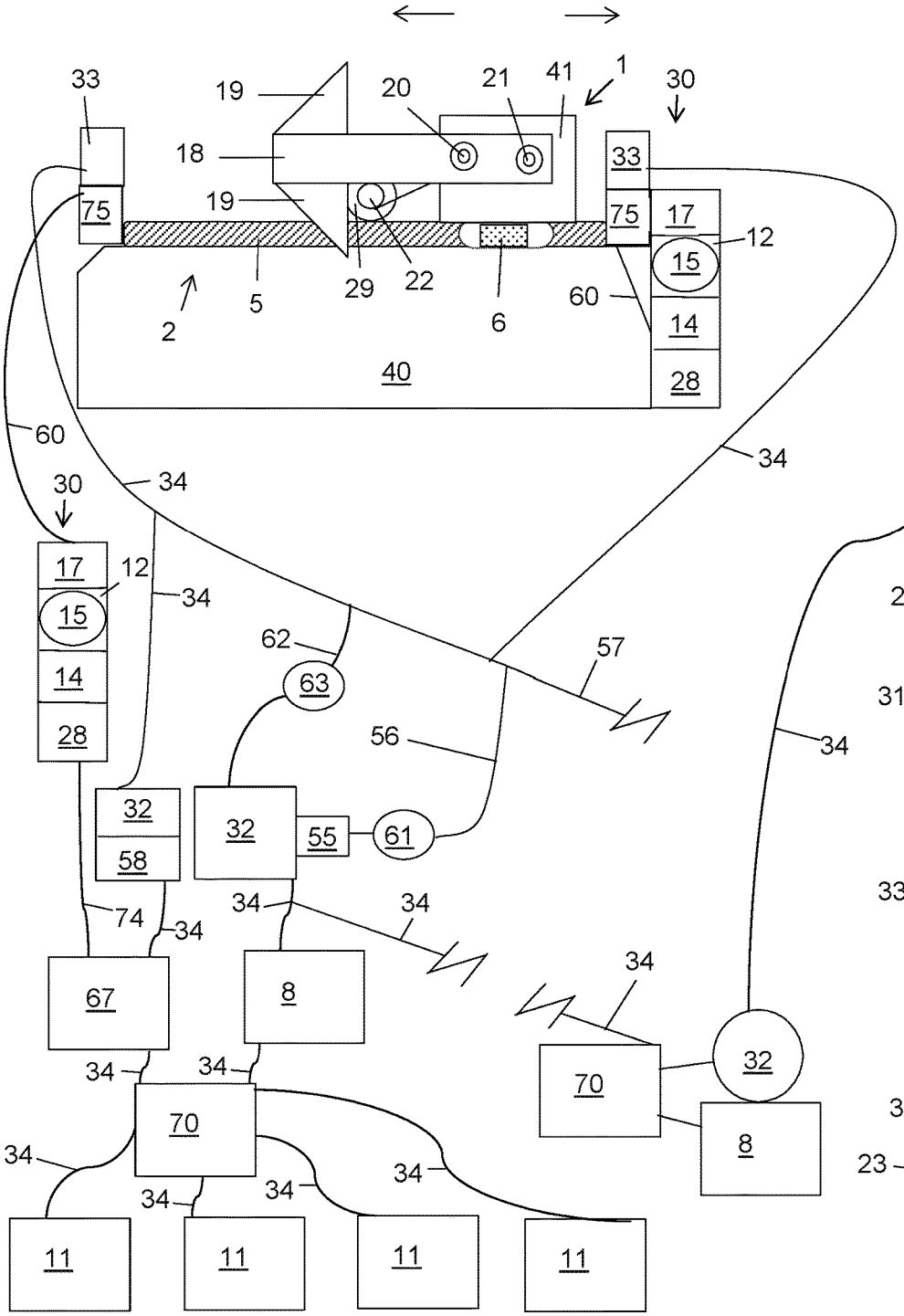

FIG. 4, one embodiment illustrating an end return device for assisting a positioning drive for moving force point illustrates how fluid, gas, and air can be used to actuate positioning drives, showing a pumping unit speed reducer with crank arms at 270 degrees with a moving crank shaft force point positioning drive that is sandwiched by the speed reducer housing and a speed reducer pedestal. Also showing optional embodiments with a multi-well manifold for electric, pneumatic, and hydraulic actuation.

Figure 5:
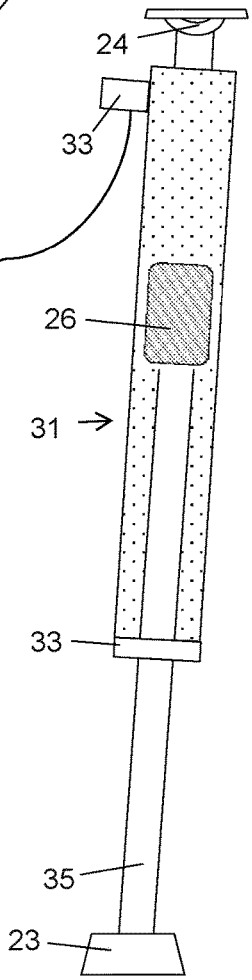

FIG. 5, one embodiment illustrating a beam piston type air compressor for an end return device for assisting a positioning drive for moving force points, showing air lines, air ports, air reserve tank, and optional auxiliary air compressor or hydraulic pump with a manifold, for a pumping unit with moving force point positioning drives.

Figure 6:
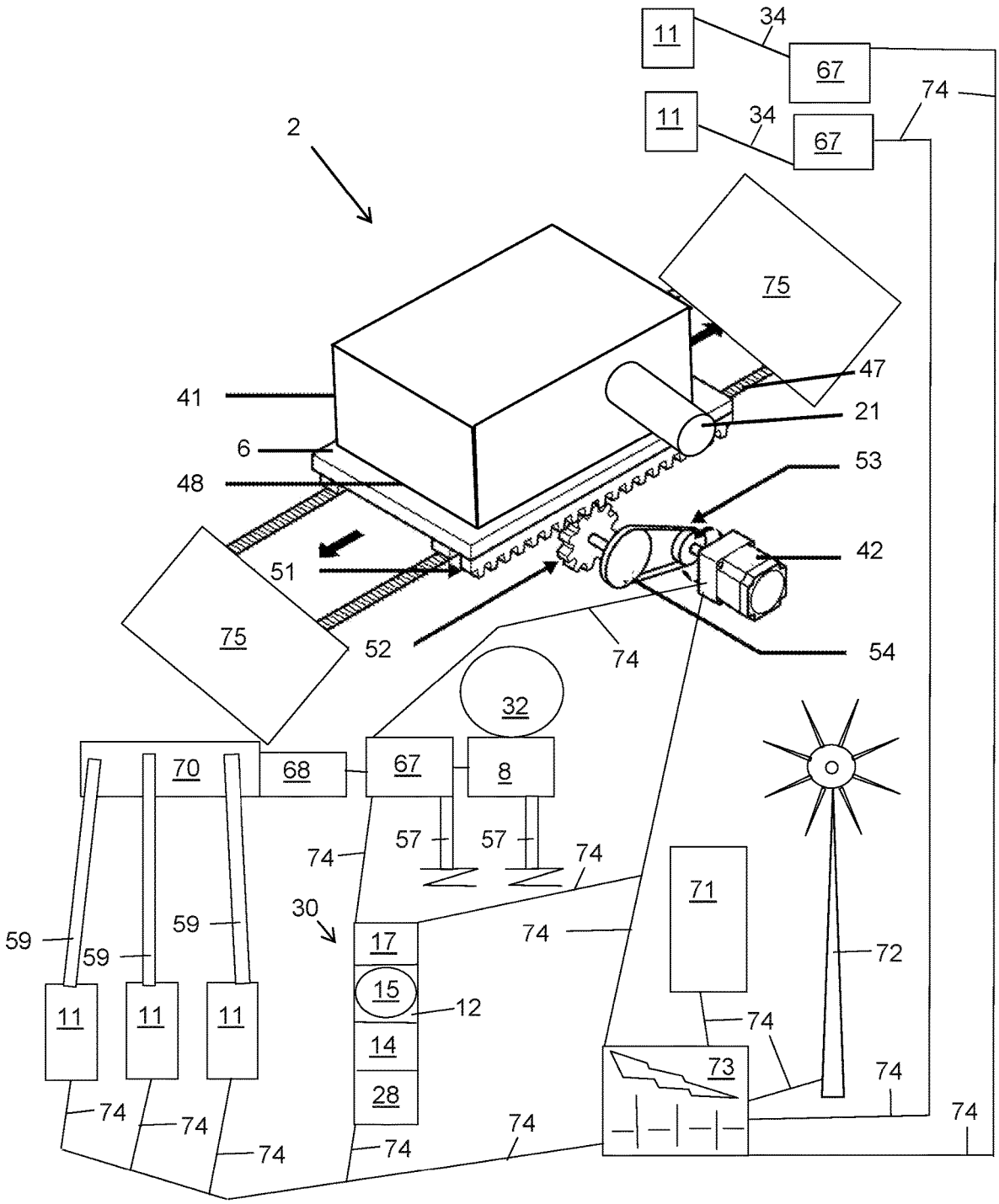

FIG. 6, one embodiment illustrating an end return device for assisting a positioning drive for moving force point with rack and pinion actuator.

Figure 7:
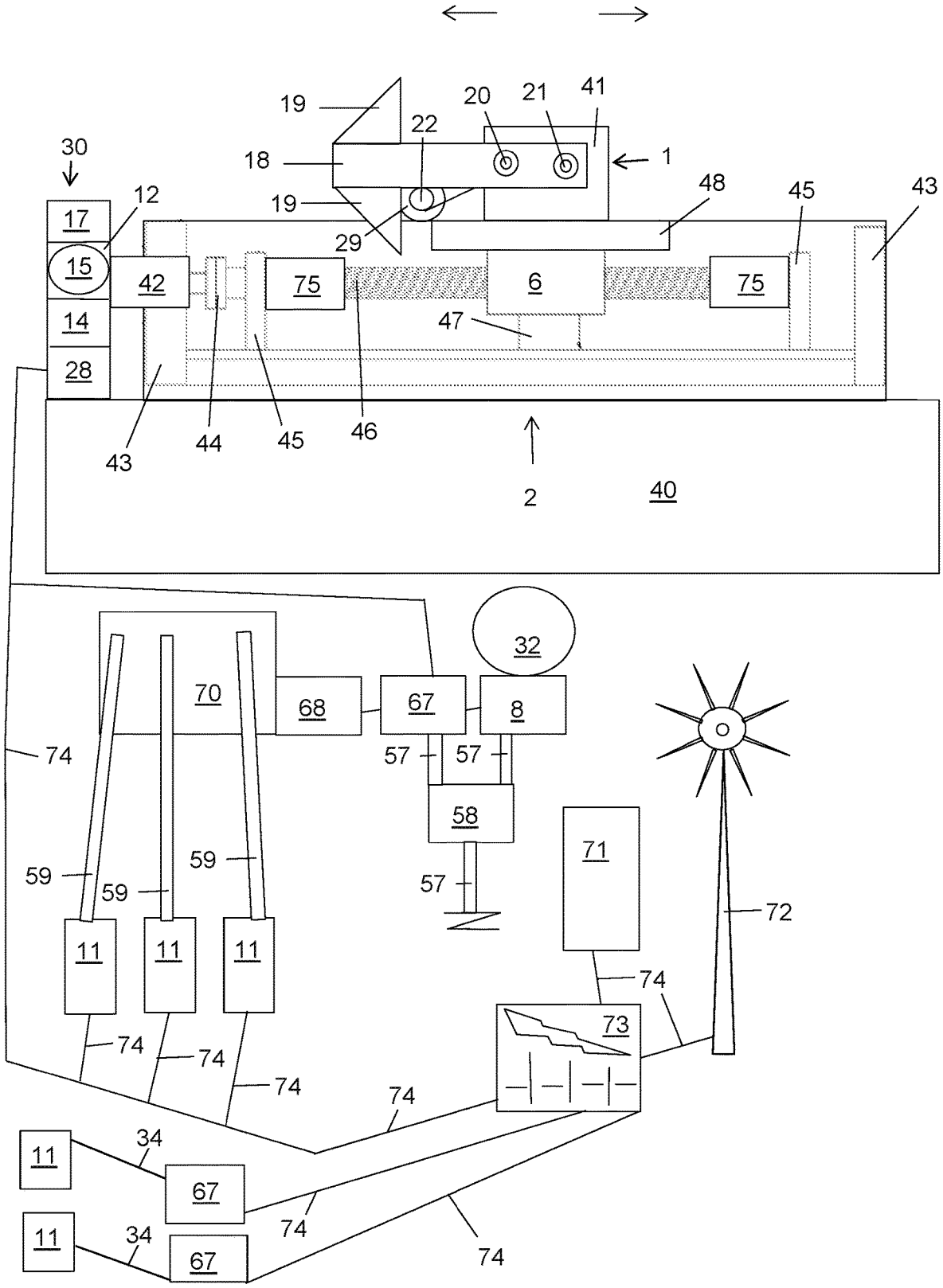

FIG. 7, illustrates an embodiment with an end return device for assisting when positioning element of positioning drive can comprise nut of screw rotating with bearings with coupling to an electric motor, for instance a servo motor or stepper motor and encoder, held with a mount.

DESCRIPTIVE KEY

1 torque (force)
2 propulsion device-positioning drive
3 reciprocating walking beam (lever)
4 fulcrum (tipping point)
carriage (for rodless piston)
6 positioning element
7 beam angle sensor (inclinometer connected to system controller)
8 air compressor (or hydraulic pump connected to reserve tank)
9 well load
10 crank weight load
11 well
12 memory module
13 crank position sensor (magnet-transducer connected to system controller)
14 system logic controller
15 display
16 single-acting or double-acting rodless cylinder (drive positioning assembly)
17 ammeter (connected to prime mover)
18 crank arm
19 crank arm weight
20 crank pin (of crank arm)
21 moving crank shaft force point (of speed reducer)
22 motor sensor (connected to system controller)
23 piston foot (mounted on runner)
24 cylinder bearing (beam mounted)
25 effort force point (of tail bearing)
26 piston
27 load cell (sensor connected to system controller)
28 VFD (variable frequency drive connected to prime mover)
29 prime mover (connected to VFD and ammeter)
30 system controller (connected to sensors/positioning drive)
31 beam air compressor (with air hose to air reserve tank)
32 reservoir tank
33 pressure port
34 air line or gas line or water line or fluid line
35 piston rod
36 horse head
37 beam pumping unit (conventional class 1 lever showing invention)
38 samson post
39 runner
40 speed reducer pedestal
41 speed reducer
42 electric motor
43 enclosure mount
44 coupling
45 bearing
46 screw
47 slide
48 table
49 sensor
50 v-belts (from prime mover to unit sheave)
51 rack
52 pinion
53 motor pulley
54 pinion pulley
55 casing back pressure regulator
56 gas line in
57 air, gas, or fluid return line
58 gas sales meter or fluid return manifold
59 pitman arm
60 controller connection
61 gas liquid scrubber accumulator
62 fluid line
63 hydraulic accumulator
64 moving beam counter weight
65 linear motor electric control
66 linear motor positioning drive
67 electric generator drive
68 manifold control
69 flow line
70 manifold
71 solar panels
72 wind turbine
73 grid storage or battery storage
74 power line
75 end return device
76 permanent magnet

DETAILED DESCRIPTION OF THE INVENTION

As used throughout this application, the term "end return device" 75 is intended to mean an ending of motion and starting of motion at terminus turn around device for assisting with starting and stopping a propulsion device (or positioning drives 2) for positioning the location of at least one of an effort force point 25, and a crank shaft force point 21, and a beam counterweight moving 64 in real time. The propulsion device 2 is connected to at least one of a crank shaft force point 21 (which is rigidly connected to the crank pin 20) disposed on a speed reducer 41, an effort force point 25 disposed on a tail bearing 25, and a beam counterweight moving 64 in real time disposed on a walking beam 3. The propulsion device 2 moves the "moving force points" laterally between the end return devices 75.

As used throughout this application, the term "force point poisoning drive" or "positioning drive" 2 is a singular term which is intended to mean and refer to a singular propulsion device 2 for continuous positioning the location of a corresponding at least one of an effort force point 25, a crank shaft force point 21, and a beam counterweight force point moving 64 in real time. Thus, one positioning drive 2 is connected to a crank shaft force point 21, which is the center point of the crank shaft disposed on a speed reducer 41. Another positioning drive 2 is connected to an effort force point 25 which is disposed at the center point of a tail bearing shaft 25. Still another positioning drive 2 is connected to a center of a beam counterweight moving 64 continuously in real time disposed on a walking beam pumping unit 37. Each positioning drive 2 continuously moves "force points" laterally between the end return devices 75, that is, the moving beam weight center 64, effort force point center 25, and speed reducer crank shaft center 21 (which is rigidly connected to the crank pin 20). Thus, as used herein, the term "propulsion device 2" refers to the three individual positioning drives 2 collectively.

As used throughout this application, the term "force point" is intended to mean at least one of an effort force point 25 and a crank shaft force point 21 (which is rigidly connected to the crank pin 20) and a beam counterweight force point 64 that continuously move in real time. A positioning drive 2 moving in real time, which is a propulsion device 2, is connected to at least one of a crank shaft force point 21 (which is rigidly connected to the crank pin 20) disposed on a speed reducer 41 and an effort force point 25 disposed on a tail bearing 25 and a moving beam counterweight 64 disposed on a walking beam 3. The force point is the location point where the force is centered.

As used throughout this application, the term "counterbalance" is intended to mean the amount of effective weight the dead weight of the block of steel called "counterweight" 10 must exert to effect a desired result on a well load 9. The term "weight" and "dead weight" when referring to a "counterweight" 10, is used for the sake of simplicity and is not intended to limit the "counterweight" 10, instead, the term "weight" and "dead weight" when used in the context of the "counterweight" 10 is intended to include any and all manners of a "counterweight" 10, including but not limited to reciprocating counterweight, counter weight and counterweight.

As used throughout this application, the term "net torque" is intended to mean the amount of torque that speed reducer 41 or prime mover 29 must exert to effect a desired result on a well load 9.

As used throughout this application, the term "torque factor" is defined in API Specification 11E, Appendix C, "The torque factor for any given crank angle is the factor that, when multiplied by the load 9 in pounds at the polished rod, gives the torque 1 in inch-pounds at the crankshaft 21 of the pumping unit speed reducer 41."

As used throughout this application, the term "cogging" of electrical motors is the torque due to the interaction between the permanent magnets of the rotor and the stator slots of a permanent magnet machine. It is also known as detent or no-current torque. Cogging torque is an undesirable component for the operation of such a motor. The phenomenon of magnetic locking between the stator and the rotor teeth is called cogging or teeth locking. Even after applying full voltage to the stator winding, the rotor of a 3 phase induction motor fails to start. This condition is known as cogging or magnetic locking. Once the motor is rotating, cogging does not affect the performance any longer, hence the end return device initiates motion to reduce the cogging effect.

As used throughout this application, the term "Permissible Load" is the polished rod load 9 necessary to give a resultant net torque 1 equal to the API rating of the speed reducer 41 with a certain amount of counterbalance 10. This load should be calculated for each 15 degree crank position.

As used throughout this application, the term "unbalanced load" on a beam pumping unit 37 is intended to mean where the load 9 in the lift direction exceeds the load 9 in the return direction.

In accordance with embodiments of the invention, the best modes are presented in terms of the described embodiments, herein depicted within FIG. 1 through FIG. 7. However, the disclosure is not limited to the described embodiments and, upon studying the instant application, a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only certain configurations have been shown and described for purposes of clarity and disclosure and not by way of limitation of scope.

It can be appreciated that, although such terms as first, second, etc. may be used herein to describe various elements, these elements should not be limited by these terms. These terms are only used to distinguish one (1) element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or "comprises" is open-ended, and includes one (1) or more stated elements, steps or functions without precluding one (1) or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. It should also be understood that the sizes and relative orientations of the illustrated elements are not shown to scale, and in some instances they have been exaggerated for purposes of explanation.

Embodiments of the present invention can be used in conjunction with the four bar mechanism and linked to work as a reciprocating rod pump.

In one embodiment the end return 75 devices provide assistance for a positioning drive 2 to increase the efficiency of positioning drives 2 for moving force points which increase efficiency of reciprocating beam pumping units 37.

Moving the force points as efficiently as possible is desirable. Moving the force points in real time on a pumping unit 37 can increase the geometric efficiency of the pumping unit 37. There are several embodiments of the moving force points: a moving effort force point 25, a moving crank shaft force point 21, and a moving beam counter weight 64 force point on a pumping unit 37. One low maintenance embodiment is propulsion utilizing permanent magnets 76. This invention provides the push start that allows initiating a magnetic field for propulsion with a permanent magnet 76 and reduce the cogging effect; and a push start can also aid the several other propulsion methods.

In one embodiment we are teaching an end return 75 device providing assistance for a positioning drive 2 providing a means for initiating magnetic propulsion with a permanent magnet 76. Additional to the above, we are describing an end return device 75 providing a means for reducing cogging. The end return device 75 can be disposed on a beam pumping unit 37 member used for a positioning drive 2.

In one embodiment the end return 75 device providing assistance for a positioning drive 2 is located at the extremities of the positioning drive 2 range of travel. That is both ends of the walking beam 3 for moving beam counter weight 64 and moving effort force point 25, and both ends of the extended gear box pedestal 40 for moving crank shaft force point 21. The positioning drive 2 moves laterally between the end return devices 75 moving the "moving force points": the moving beam counter weight 64, the tail bearing effort force point 25, speed reducer moving crank shaft force point 21 to which the crank arm 18 and crank pin 20 are attached.

The end return 75 device must be very securely mounted, preferably welded in place, but an adequate nut and bolt or rivet fastening is feasible. The dynamic forces encountered for possibly 20,000 more or less reversals per day must be duly respected.

In one embodiment the end return device 75 providing assistance for a positioning drive 2 disposed on the pumping unit 37 member is providing the means for urging a permanent magnet 76, that is, push starting the permanent magnet 76 thereby inducing current in a magnetic field to initiate magnetic propulsion and reduce the cogging effect.

In one embodiment the end return 75 device providing assistance for a positioning drive 2 disposed on the beam pumping 37 unit member is also providing the means for a moving permanent magnet 76 to reverse direction.

In one embodiment the end return 75 device providing assistance for a positioning drive 2 disposed on the beam pumping unit 37 member is also providing the means for decelerating the moving permanent magnet 76.

In one embodiment the end return 75 device providing assistance for a positioning drive 2 disposed on the beam pumping unit 37 member is also providing the means for accelerating the moving permanent magnet 76 to reduce the cogging effect.

Additional to the above, in one embodiment we are teaching an end return 75 device providing assistance for a positioning drive 2 providing a means for initiating a magnetic propulsion for which the end return 75 device is providing the means for at least one of propelling and push starting a permanent magnet 76 to reduce the cogging effect.

In one embodiment the end return 75 device providing assistance for a positioning drive 2 is providing the means for at least one of halting and stopping the permanent magnet 76.

In one embodiment the end return 75 device providing assistance for a positioning drive 2 is providing the means for at least one of propelling and push starting a linear motor 66 to reduce the cogging effect.

In one embodiment the end return 76 device providing assistance for a positioning drive 2 is providing the means for at least one of halting and stopping the permanent magnet 76 the linear motor 66.

Additional to the above, in one embodiment we are teaching an end return 75 device providing assistance for a positioning drive 2 providing a means for a initiating magnetic propulsion comprising at least one of: a means for adjusting at least one of force and strength; a means for modifying at least one of position and placement;

- a means for adjusting at least one of position and placement; a means for modifying at least one of position and placement;
- a means for adjusting at least one of speed and velocity; and a means for modifying at least one of speed and velocity.

Additional to the above, in one embodiment we are teaching an end return device 75 providing assistance for a positioning drive 2 providing a means for initiating a magnetic propulsion comprising at least one of an adjustable and modifiable force point;

- an adjustable and a modifiable moving effort force point 25;
- an adjustable and a modifiable moving crankshaft force point 21;
- and an adjustable and a modifiable moving beam counter weight 64 force point.

Additional to the above, in one embodiment we are teaching an end return 75 device providing assistance for a positioning drive 2 providing a means for a initiating magnetic propulsion comprising at least one of an embodiment providing a means for utilizing the device on class 1 lever geometry;

- an embodiment providing a means for utilizing the device on class 2 lever geometry;
- and an embodiment providing a means for utilizing the device on class 3 lever geometry.

Additional to the above, in one embodiment we are teaching an end return 75 device providing assistance for a positioning drive 2 for actuating a force point positioning drive 2: it can be a means for at least one of launching and halting a permanent magnet 76 device on a force point positioning drive 2;

- a means for providing at least one of push starting and braking and stopping a permanent magnet 76 device on a force point positioning drive;
- the end return device 75 providing assistance for a positioning drive 2 disposed on a beam 3; the end return 75 device disposed on opposite ends of the beam 3;
- the end return 75 device providing assistance for a positioning drive 2 disposed on opposite ends of a pedestal 40;
- and the end return 75 device providing assistance for a positioning drive 2 disposed on opposite ends of a beam pumping unit 37 member;
- the end return 75 device providing assistance for a positioning drive 2 providing the means for at least one of propelling and push starting a linear motor 66;
- the end return device 75 providing assistance for a positioning drive 2 providing the means for at least one of halting and stopping the linear motor 66;
- the end return 75 device providing assistance for a positioning drive 2 is providing the means for at least one of propelling and push starting a rack 51 and pinion 52;
- the end return 75 device providing assistance for a positioning drive 2 providing the means for at least one of halting and stopping the permanent magnet 76 the rack 51 and pinion 52;
- the end return 75 device providing assistance for a positioning drive 2 providing the means for at least one of propelling and push starting a screw 46 bolt drive;
- and the end return device 75 providing assistance for a positioning drive 2 providing the means for at least one of halting and stopping the screw 46 bolt drive;
- the end return 75 device providing assistance for a positioning drive 2 providing the means for at least one of propelling and push starting a pneumatic drive 16;
- the end return 75 device providing assistance for a positioning drive 2 providing the means for at least one of halting and stopping the pneumatic drive 16;
- the end return 75 device providing assistance for a positioning drive 2 providing the means for at least one of propelling and push starting a hydraulic drive;
- and the end return 75 device providing assistance for a positioning drive 2 providing the means for at least one of halting and stopping the hydraulic drive.

Additional to the above, in one embodiment we are teaching embodiments for an end return 75 device providing assistance for a positioning drive 2 providing a means for a initiating a magnetic propulsion and reducing the cogging effect.

Suitable embodiments we are teaching can comprise at least one of the following:

1. spring absorber and a spring cushioner;
2. a spring repeller and a spring push starter;

In one embodiment the element of shock is absorbed by the spring. Springs, while having the ability to return the moving force point toward its original location, have the natural tendency to extend a little further than necessary.

In one embodiment the shock absorber is a damper as it serves to dampen motion. While shock is absorbed by the spring, the damper functions to modulate the bouncing oscillations. The beneficial feature of a damper is that its resistance to motion is proportional to how fast the motion occurs.

3. a hydraulic absorber and a hydraulic;
4. a hydraulic repeller and a hydraulic push starter;

In one embodiment the shock absorbers can be an oil-filled cylinder. When the positioning drive 2 moves the end return 75, a piston moves up and down through the oil-filled cylinder. The up-and-down movement of the piston forces small amounts of fluid through tiny holes orifices in the piston head.

In one embodiment the rebound damping regulates the speed at which the shock recovers, or bounces back, from the impact and returns to its full travel. Much like a compression circuit, rebound damping relies on oil moving through a circuit to regulate the speed at which the suspension extends after being compressed.

One embodiment can use oil-based shock absorbers filled with higher viscosity oil that make the absorption stiffer. One embodiment could use gas filled shock absorbers that make the absorption stiffer.

5. a pneumatic absorber and a pneumatic cushioner;
6. a pneumatic repeller and a pneumatic push starter;

In one embodiment the air system can be adjusted for a softer or a harder effect for improved control. In the case of heavy loads an air system offers consistency. A compressor inflates the system to a certain pressure in order to behave like springs.

7. a magnetic absorber and a magnetic cushioner;
8. a magnetic repeller and a magnetic push starter;

There are several embodiments that use magnetic devices. One embodiment adapts and adjusts the shock absorption in real-time in response to changes in load in order to deliver optimal shock damping for the best possible result.

In one embodiment the electromagnets are able to create a variable magnetic field across the fluid passages and the field can be altered in strength to adjust the damping force in just 100 nanoseconds. When the magnets are off the piston moves inside the damper body and the fluid travels through the passages freely.

In one embodiment of a magnetic system, two permanent magnets made of Neodymium material are placed inside the shock absorber cylinder such that both face the same pole so they produce a repulsive magnetic flux force when they come closer due to shocking load. This repulsive magnetic flux force is used as shock absorbing media and provides damping force. This suspension system has no leakage problem unlike in a hydraulic and pneumatic system, so has less maintenance cost.

9. an elastomer absorber and an elastomer cushioner;
10. an elastomer repeller and an elastomer push starter;

In one embodiment an effective elastomer is polyurethane with 70D to 90D hardness.

In one embodiment an elastomer suspension system uses rubber cushioning placed at the parts that take a lot of the force. Elastomers have horizontal and vertical action to absorb unexpected shocks.

In one embodiment rubber is used as shock and vibration absorber having elastic and viscous properties such as high inherent damping, deflection capacity, and energy storage. Rubber attenuates low frequency vibrations because of the viscous damping properties.

In one embodiment the rubber is an effective absorber of shock waves, the energy of vibration is absorbed by the rubber material and protects the pumping unit 37 from any damage. The energy of vibrations first goes to rubber where it stops moving further to the pumping unit 37.

11. and an eddy current brake;
12. and an eddy current cushioner;
13. and an eddy current push starter.

In one embodiment the eddy currents, also called Foucault's currents, are loops of electrical current induced within the end return 76 device assisting the positioning drive 2 by a changing magnetic field in the conductor, which is the end return 76 device assisting the positioning drive 2, according to Faraday's law of induction. This effect is employed in eddy current brakes.

An electro-magnetic field induced by motion relative to a magnetic field is called a motional emf. This is represented by the equation emf=LvB, where L is length of the object moving at speed v relative to the strength of the magnetic field B.

In one embodiment the an electromagnetic shock-absorber comprises a copper and steel combined tube, a piston, permanent magnets, and a steel ring. A magnet fixed on the piston moves through the tube when driven by an external shock. Shock energy is partially dissipated by an eddy current damping force and a friction force generated from the relative motion of the tube and the magnet. Some of the energy is stored in a magnetic spring consisting of two magnets in which their poles act against each other.

In one embodiment when a conductive material is subjected to a time-varying magnetic flux, eddy currents are generated in the conductor. As the eddy currents are dissipated, energy is removed from the system, thus producing a damping effect. Eddy currents are currents which circulate in conductors like swirling eddies in a stream. They are induced by changing magnetic fields and flow in closed loops, perpendicular to the plane of the magnetic field. Like any current flowing through a conductor, an eddy current will produce its own magnetic field.

In one embodiment induced current would be the current that results in a conductor due to a moving magnetic field. Eddy current is when the induced electrical current then generate their own magnetic moments in that conducting core. These magnetic moments oppose the source magnetic field.

Eddy currents in conductors of non-zero resistivity generate heat as well as electromagnetic forces. The electromagnetic forces can be used for levitation, creating movement, or to give a strong braking effect.

In one embodiment an Eddy current can be produced by both electromagnets and permanent magnets, as well as transformers and by the relative motion generated when a magnet is located next to a conducting material.

In one embodiment the laminations are thin so they have relatively high resistance. The planes of these sheets are placed perpendicular to the direction of the current that is set up by the induced emf. The planes of these sheets are arranged parallel to the magnetic fields so that they can cut across the eddy current paths.

In one embodiment generally speaking you have induced current in a conductor if it is in close proximity to another conductor. Current flow in a conductor produces a magnetic field around the conductor. Any other conductor moving through that magnetic field will have a current induced in it.

14. a regenerative brake.

In one embodiment regenerative braking in the end return 75 is an energy recovery mechanism that slows down the moving positioning drive 2 by converting its kinetic energy into a form that can be either used immediately or stored until needed.

In one embodiment regenerative braking uses a linear motor as a generator to convert much of the kinetic energy lost when decelerating back into stored energy in the pumping unit's battery or through switches for momentary storage in the electric grid.

To teach the importance of this invention we teach one embodiment providing a means for partially self-perpetuating a pumping system. The system we are teaching is an end return 75 assistance for a positioning drive 2 apparatus used to initiate propulsion for a system of moving force points that increase efficiency for integrating with a reciprocating downhole rod pump connected to the surface by a rod or rods for the purpose of lifting fluid from a well bore. This invention is an end return device 75 which can be used on a positioning drive 2 for a moving force point system which is uniquely comprised of a manifold 70, reservoir 32, positioning drive 2 as a means for actuating pumping unit 37 moving force points, including moving effort force point 25, moving crank shaft force point 21, and moving beam weight force point 64.

Of the many applications that embodiments of the present end return 75 for a positioning drive 2 invention apply to, now consider an embodiment of the present end return 75 for a positioning drive 2 invention as applied to class 1 lever, class 2, and class 3 lever, and in this particular example conventional crank arm 18 walking beam 3 pumping unit 37 where circular motion is transferred from prime mover 29 to speed reducer 41 moving crank shaft force point 21 and rotating crank arm 18 and then converted to linear motion with crank arm 18 and crank pin 20 articulated with moving effort force point 25 to walking beam 3 moving beam counter weight force point 64, and with this teaching speed reducer 41 net torque and prime mover 29 net torque is reduced by moving force points disposed on a beam pumping unit 37.

This end return 75 assistance for a positioning drive 2 device solves the current problem of high electricity requirements for positioning drives 2 which can be used to reduce net torque needed to lift and lower the unsolved unbalanced well load 9 in the current practice, by teaching end return 75 assistance for a positioning drive 2 by push starting the permanent magnet to reduce the cogging effect and thus initiates efficient propulsion of multiple position-changing-moving force points actuated by positioning drive 2, whose structurally determined and timed positions are, for moving effort force point 25 and moving crank shaft force point 21, and for moving beam weight force point 64, in reference to the crank pin 20 either forward or aft of the speed reducer, which reduces lifting or lowering net torque 1 when the walking beam 3 pumping unit 37 crank arms 18 rotate. Cost effectively moving the positioning drive 2 is improved with this invention.

End return 75 assistance for a partially self-perpetuating positioning drive 2 reciprocating beam pumping unit 37 system has a manifold 70 providing a means for collecting a flow of fluid to actuate the positioning drive 2; and the manifold 70 provides a means for controlling the flow of fluid to the said positioning drive 2; and a reservoir 32 provides a means for cooling the fluid returning from the positioning drive 2 to a flow line 69 for returning to the system.

A partially self-perpetuating method of pumping a well 11 using an end return 75 assistance for a positioning drive 2 has a means for partial self-perpetuation using permanent magnets 76; supplemented with the well tubing fluid pressure providing a means for pushing fluid through a positioning drive 2; the well casing gas pressure providing a means for pushing gas through the positioning drive 2; at least one of the gas and the fluid providing a means for actuating the positioning drive 2; at least one of the gas and the fluid providing a means for actuating a compressor 8; the compressor 8 providing a means for actuating the positioning drive 2; the well tubing fluid providing a means for actuating the positioning drive 2 which can provide a means for pumping the well 11; and the well 11 casing gas providing a means for actuating the positioning drive 2 which can provide a means for pumping the well 11.

A partially self-perpetuating method of pumping a well 11 using an end return 75 assistance for a positioning drive 2 is with the permanent magnet 76 propelled positioning drive 2 as above, supplemented where at least one of compressed well gas and compressed well 11 fluid can provide a means for actuating an electricity generator 67; and the electricity generator 67 can provide a means for pumping the well 11; the electricity generator providing a means for powering a prime mover for providing a means for pumping the well; the electricity generator 67 can provide a means for actuating a positioning drive 2 which can provide a means for pumping the well 11; and the electricity generator 67 can provide a means for actuating controls 68 and 30 to provide a means for pumping the well 11.

A partially self-perpetuating method of pumping a well 11 with end return 75 assistance for a positioning drive 2 is with the permanent magnet 76 propelled positioning drive 2 as above, supplemented with a positioning drive 2 manifold 70 that can provide a means for easy access to at least one of hydraulic and air power; a means for integrating with an existing power source; a means for actuating a compressor 8 without needing at least one of a new and a used and a separate compressor 8 engine; a means for cost-effectiveness when comparing to other beam pumping unit air compressors; a means for relative ease of at least one of installation and use; a means for at least one of safety and reliability; and, a means for transferability between beam pumping units with similar hydraulics.

A partially self-perpetuating method of pumping a well 11 with end return 75 assistance for a positioning drive 2 is with the permanent magnet 76 propelled positioning drive 2 as above, supplemented with a manifold 70 as above, wherein the manifold can provide a means for gathering at least one of gas and fluid from at least one of and more than one of flow line 69; the manifold can provide a means for gathering at least one of gas and fluid from at least one of and more than one of wells 11; the manifold 70 can provide a means for routing at least one of gas and fluid from at least one of and more than one of flow line 69; and the manifold 70 can provide a means for routing at least one of gas and fluid from at least one of and more than one of wells 11.

A partially self-perpetuating method of pumping a well 11 with end return 75 assistance for a positioning drive 2 is with the permanent magnet 76 propelled positioning drive 2 as above, supplemented by at least one of gas and fluid being used but not consumed or lost and being available for reuse after use. At least one of gas and fluid is returned to the system for reuse after use. At least one of gas and fluid is delivered and returned via a flowline 69.

A partially self-perpetuating method of pumping a well 11 with end return 75 assistance for a positioning drive 2 is with the permanent magnet 76 propelled positioning drive 2 as above, supplemented with an embodiment, FIG. 4 system positioning drive 2 preferably comprising a single-acting or double-acting rodless cylinder 16, which preferably sits on top of speed reducer pedestal 40 or runner 39.

A partially self-perpetuating method of pumping a well 11 with end return 75 assistance for a positioning drive 2 is with the permanent magnet 76 propelled positioning drive 2 as above, supplemented with a moving crank shaft force point 21 as a member of a speed reducer 41 which is preferably disposed above positioning drive 2 with a cushioned end return 75 on each end to soften reversals. In one embodiment, movable positioning element 6 of positioning drive 2 can comprise rodless positioning element 6, which can be magnetic and thereby securely attract metallic moving crank shaft force point 21 to follow its movements. The moving effort force point 25 and moving beam counterweight weight force point 64 are similarly positioned and equipped for maximum position efficiency by the positioning drive 2.

A partially self-perpetuating method of pumping a well 11 with end return 75 assistance for a positioning drive 2 is with the permanent magnet 76 propelled positioning drive 2 as above, supplemented in one embodiment by FIG. 3, air pressure for single-acting or double-acting rodless cylinder 16 positioning element 6 of positioning drive 2 which can be supplied by any capable and/or suitable air supply with an air line 34 to reserve tank 32 and an air line 34 to a valve such as 4/2 or 5/2 valve.

A partially self-perpetuating method of pumping a well 11 with end return 75 assistance for a positioning drive 2 is with the permanent magnet 76 propelled positioning drive 2 as above, supplemented when the beam pumping unit 37 is pumping a well 11 that produces some natural gas the positioning drive 2 can be partially self-perpetuating where the natural gas is normally separated from fluid in the casing, the gas can be used at flowline pressure, nominally 30-40 psi, or can be caused to accumulate hundreds of pounds of pressure via a casing back pressure regulator 55 and then pass through a gas liquid scrubber 61 as can be a standard operating procedure in special production scenarios (for instance in some cases to reduce sand production, decrease oil viscosity, decrease BS&W, to push casing fluid level lower, etc.), and then routed under pressure through a gas line in 56 to actuate a single-acting or double-acting rodless cylinder 16 type positioning drive 2, and then the higher pressure gas is vented back to a lower pressure gas return line 57, then routed through the natural gas sales meter 58 and back into the system through the gas sales line. This method has efficiency because it can use the already existing work that produces gas under pressure by the pumping system to energize an actuator without requiring additional energizing work.

A partially self-perpetuating method of pumping a well 11 with end return 75 assistance for a positioning drive 2 is with the permanent magnet 76 propelled positioning drive 2 as above, supplemented in one embodiment to increase the volume of gas being gathered by rerouting flowlines 69 from multiple neighboring wells 11 at a manifold 70 and then routing through a handling system with options including compressor 8, reservoir tank 32, back pressure regulator 55, gas line in 56, gas or fluid return line 57, gas sales line or fluid return meter 58, gas scrubber and accumulator 61, fluid line 62, hydraulic accumulator 63, electricity generator 67, power line 74, manifold control 68. Thus, a group of wells 11 can be mingled to increase the partial self-perpetuation capacity of a single well 11 in the group.

A partially self-perpetuating method of pumping a well 11 with end return 75 assistance for a positioning drive 2 is with the permanent magnet 76 propelled positioning drive 2 as above, supplemented in one embodiment by a pumping well 11 when the well is doing what known as flumping, that is flowing while being pumped; and when this is the case, more volume of fluid and gas than from pumping alone is brought to the surface. Fluid and gas from one or more wells 11 can be routed to a manifold 70 to actuate the positioning drive 2. Thus, a group of wells 11 can be mingled to increase the partial self-perpetuation capacity of a single well 11 in the group.

A partially self-perpetuating method of pumping a well 11 with end return 75 assistance for a positioning drive 2 is with the permanent magnet 76 propelled positioning drive 2 as above, supplemented in one embodiment by a well 11 producing using a submersible pump or a progressive cavity pump that needs to be choked at the surface due to the original pump sizing exceeding the current operating conditions, and instead of choking the fluid could be routed through the manifold 70 and the resulting pressure used by the positioning drive 2. Fluid and gas from one or more wells 11 can be routed to a manifold 70 to actuate the positioning drive 2. Thus, a group of wells 11 can be mingled to increase the partial self-perpetuation capacity of a single well 11 in the group.

A partially self-perpetuating method of pumping a well 11 with end return 75 assistance for a positioning drive 2 is with the permanent magnet 76 propelled positioning drive 2 as above, supplemented in one embodiment by wells that are intermittently shut in to build pressure to enable plunger lift or gas lift systems; this shut in pressure could also be released for a positioning drive 2 system. Fluid and gas from one or more wells 11 can be routed to a manifold 70 to actuate the positioning drive 2. Thus, a group of wells 11 can be mingled to increase the partial self-perpetuation capacity of a single well 11 in the group.

A partially self-perpetuating method of pumping a well 11 with end return 75 assistance for a positioning drive 2 is with the permanent magnet 76 propelled positioning drive 2 as above, supplemented in one embodiment by a flowline from a salt water disposal pump being routed to a positioning drive 2 to be used on it's way to injection at a disposal well. Fluid from one or more wells 11 can be routed to a manifold 70 to actuate the positioning drive 2. Thus, a group of wells 11 can be mingled to increase the partial self-perpetuation capacity of a single well 11 in the group.

A partially self-perpetuating method of pumping a well 11 with end return 75 assistance for a positioning drive 2 is with the permanent magnet 76 propelled positioning drive 2 as above, supplemented in one embodiment by a flowline from a fresh water well 11 being routed to a positioning drive 2. A fresh water well 11 could be pumped by a wind mill or any suitable method. Fluid from one or more wells 11 can be routed to a manifold 70 to actuate the positioning drive 2. Thus, a group of wells 11 can be mingled to increase the partial self-perpetuation capacity of a single well 11 in the group.

A partially self-perpetuating method of pumping a well 11 with end return 75 assistance for a positioning drive 2 is with the permanent magnet 76 propelled positioning drive 2 as above, supplemented in one embodiment by powering the system pneumatically or hydraulically which in turn are powered by electricity generator 67 as an auxiliary power source to the electric grid 73 or battery storage 73 from solar panels 71, wind turbines 72, and pneumatically powered electricity generators 67 from a well 11 groups of wells 11.

DESCRIPTION OF FIGURES

FIG. 1, in one embodiment a pumping unit with three sets of end return 75 devices for assisting positioning drives 2 and three moving force points: moving effort force point 25, moving crank shaft force point 21, and moving beam weight force point 64; with beam air compressor 31, system controller 30, with multi-well manifold 70 for electricity generator 67, air compressor 8 or hydraulic pump 8; and both renewable energy as solar panels 71 and wind turbine 72, and grid storage 73 or battery storage 73.

FIG. 2, in one embodiment with an end return 75 device for assisting a positioning drive 2 for moving force point with a linear motor positioning drive 66 which is good for allowing precise control and speed;

FIG. 3, illustrates an embodiment with an end return 75 device for assistance where the positioning drive for a moving force point uses a single-acting or double-acting rodless cylinder to move the force point; also illustrating some hook-up options and a system controller. A pneumatic actuation using air pressure can be used for lightish loads of half a ton and are initially low cost, enable accurate control, and can be partially self-perpetuating.

FIG. 4, in one embodiment with an end return 75 device for assisting the single-acting or double-acting rodless cylinder 16 type positioning drive 2 where hydraulic pressure to actuate can be accumulated from pumping a fresh water well with a hydraulic accumulator 63 and back pressure. This method has efficiency because it uses the already existing work that produces water under pressure by the pumping system to energize the actuator without requiring additional energizing work.

In one embodiment to increase the volume, water can be gathered from flowlines 69 from multiple wells 11 at a manifold 70 and then routed through a system with options including compressor 8, reservoir tank 32, back pressure regulator 55, gas or fluid return line 57, gas sales line or fluid return meter 58 for returning gas and fluid back into the system, fluid line 62, hydraulic accumulator 63, electricity generator 67, and manifold control 68. Some gas wells 11 have high volume and high pressure that could be routed to actuate beam the beam pumped wells 11 described in this specification. In the 1$^{st}$ decades of the 2000s horizontally drilled and fracked wells 11 have been venting large volumes of gas and this vented gas could be routed to actuate the beam pumped wells 11 described in this specification. Using gas or oil and gas fluid requires additional safety considerations and precautions than when using water. One consideration is to locate the oil and gas flowline 69 manifolds 70 at wherever is the safest position for the gas manifold 70 with the oil and gas actuated electric generators 67 positioned nearby, and then make the electric power line 74 whatever length is required.

FIG. 5, in one embodiment, the actuation of compressed air used by pneumatic end return 75 devices for assisting positioning drives 2, can be provided by an air compressor 8, which can optionally be assisted by a single-acting or double-acting piston type beam air compressor 31 powered by beam 3. In one embodiment, a single-acting or double-acting single piston-cylinder can be used as beam air compressor 31, and is preferably pivotably connected at its top by a cylinder bearing 24 to beam 3 and the lower extremity is preferably pivotably anchored with a piston foot bearing 23 connected to the beam pumping unit 37 structure runner 39. With this configuration, air can be compressed by beam 3 actuated single-acting or double-acting piston air compressor 31 using power from beam 3 which actuates the movable positioning element 6 the length of the positioning drive 16. A two stage beam air compressor 31 embodiment can be used to increase pressure. When there is intentional negative torque achieved with a moving beam counterweight force point 64 this method has efficiency because it can use the already existing work by the pumping system to reciprocate the beam to energize the beam air compressor 31 to buck pressure without requiring auxiliary power.

Of course other configurations of air compressors can be used, depending on the total system configuration and requirements, and will provide desirable results, including but not limited to configurations in which the air compressor is connected by one or more belts to the pumping unit sheave being powered by prime mover 29 or to the sheave of prime mover 29 itself. Of course, the motive power source, which can optionally be a compressed natural gas source and including but not limited to an air compressor 8 or hydraulic pump 8, can be provided independent of prime mover 29. In one embodiment, the air compressor can include one or more rotary screw and/or reciprocating air compressors.

For embodiments that employ an end return 75 device for assisting a single-acting or double-acting hydraulic cylinder 16 with a two-direction valve, the hydraulic pressure can be supplied from motive power source, which can optionally be a beam actuated single-acting or double-acting piston hydraulic compressor 31 or hydraulic pump 8, most preferably with a pressure relief and return reservoir 32.

FIG. 6, illustrates an embodiment with an end return 75 device for assisting when positioning element 6 of positioning drive 2 can comprise rack 51 on guides 47 and pinion 52 with an electric motor 42, for instance a servo or stepper motor and encoder, which can be connected to a table 48 sandwiched between moving effort force point 25, moving crank shaft force point 21, and moving beam weight force point 64 and rack 51. Electric motor 42 can be a direct gear drive or use belt and motor pulley 53 and pinion pulley 54. A rack 51 and pinion 52 positioning drive 2 can better handle the heavy pumping unit loads of 30,000+ pounds.

FIG. 7 illustrates an embodiment with an end return 75 device for assisting when positioning element 6 of positioning drive 2 can comprise nut of screw 46 rotating with bearings 45 with coupling 44 to an electric motor 42, for instance a servo motor or stepper motor and encoder, held with a mount 43. Moving effort force point 25, moving crank shaft force point 21, and moving beam weight force point 64 with a position sensor 49 can be connected to a table 48 sandwiched between moving crank shaft force point 21 and moving positioning element 6 on slide 47 by bolt, rivet, weld, magnetism or other preferably removable fastener.

We teach control of the end return 75 system. In one embodiment an end return 75 device for assisting the positioning of moving effort force point 25, moving crank shaft force point 21, and moving beam weight force point 64 which are preferably precisely correlated and timed with the strokes per minute of beam 3 pump. Variable frequency drive 28 can slow the upward or downward speed of load 9 in mid stroke when an end return 75 device for assisting moving effort force point 25, moving crank shaft force point 21, and moving beam weight force point 64 position causes reduced net torque 1. Variable frequency drive 28 with programmable system logic controller 14, which is preferably programmed for this application, can include a component of the preferred configuration. This is because desired strokes per minute of beam 3 can be controlled in coordination with data from load cell 27 via the chosen speed of prime mover 29. This configuration increases well management and is available when variable frequency drive 28 is integrated with a sensor package. This embodiment with an assisting end return 75 device can possibly allow a longer pump stroke without increasing torque 1 in the speed reducer 41 and prime mover 29 and can possibly allow a slower pumping speed which is sometimes operationally desirable.

The moving force points with an end return 75 device for assisting positioning drive 2 can be installed on already existing pump jacks at existing well installations by attaching an end return 75 device for assisting positioning drive 2 to either the existing beam 3, pedestal 40 or runners 39, or adapting any other workable method to move moving force points on positioning drive 2. Alternatively, an end return 75 device for assisting moving force points can be part of original equipment on newly manufactured reciprocating beam pumping units 37. This may allow OEM design to have longer beam pump stroke lengths and smaller net torque 1 capacity speed reducers 41 than those prior to this invention. This is because of the increased efficiency with the moving force points position on positioning drive 2 effectively reducing the lifting and lowering torque factor and net torque 1. And, with those longer strokes possible, the pump jack can operate at slower strokes per minute, possibly reducing tubing and rod wear, and also allow the use of lower horsepower prime mover 29. As such, reciprocating beam pumping unit 37 design can possibly be improved with longer stroke lengths and smaller speed reducers 41, to accommodate the benefits of embodiments of this invention.

An end return 75 device for assisting positioning drives 2 is beneficial because benefits of moving effort force points are calculable. The following will teach why the end return 75 device assisting the positioning drive 2 is a beneficial improvement to the art.

For beam counterweighted walking beam 3 pumping units 37, load prediction calculations are directly proportional to the effective counterbalance. And calculations for rotary counterweight pumping units can include the API 11E standard equation for calculating net speed reducer 41 torque which is:

$$TN = \mathrm{TF}(W-B) - M \sin\theta$$

Where;

θ=Angle of crank arm 18 rotation in a clockwise direction viewed with the wellhead to the right and with zero degrees occurring at 12 o'clock degrees, TF=torque factor for a given crank angle (from manufacturer's tables or computed from geometric measurements), B=structural unbalance (from manufacturer or measured), Tn=Net torque, inch-pounds, at the crankshaft for a given crank angle θ, W=polished rod load at any specific crank angle θ, M=maximum moment of the rotary counterweights (from manufacturer or computed from measurements), With these input values Tn=net torque are computed.

The rotational motion of crank arm 18 causes a maximum moment of rotary crank arm 18 weight, crank shaft, and crank pin 20 about the crankshaft whose standard nomenclature is written in thousands of inch-pounds. That maximum moment is nominally the position of the maximum effective crank arm 18 counterbalance at a little less than 90 degrees and a little less than 270 degrees. At 90 degrees and at 270 degrees is nominally the position of maximum net torque and maximum requirement for counterbalance effect. So when the positioning drive 2 causes the moving effort force point 25 and moving crank shaft force point 21 to remain vertically oriented with the crank pin 20 it is decreasing the torque factor to compensate and offset the maximum net torque requirement in the horizontal crank arm 18 position. And moving beam weight force point 64 also increases counter balance efficiency, so positioning drives 2 are useful for moving force points.

An end return 75 device for assisting positioning drives 2 for moving force points can be retrofitted and installed on already existing units on the existing well installations by using attaching methods such as but not limited to bolts, rivets, weld, and other suitable methods.

End return 75 devices for assisting positioning drives 2 for moving force points are desirable to be incorporated in original equipment manufacturing, OEM, on newly manufactured walking beam 3 pumping units 37. Both retrofitted and OEM can employ user discretion to fit the particular specific operational design parameters.

Retrofitted and OEM walking beam 3 pumping units 37 utilizing this invention can potentially allow for longer beam pump stroke lengths and smaller torque capacity speed reducers 13 than those of current practice in known systems because of the increased efficiency with moving force points positions on positioning drive 2 effectively reducing the required lifting and lowering net torque.

And also with those longer strokes walking beam 3 pump can operate at slower strokes per minute, and also allow the use of reduced prime mover 29 horsepower, so new beam pumping unit 37 designs will want to accommodate the benefits of this invention, where:

Load×Distance from tipping point=Counterweight Mass×Distance from tipping point and is called load moment.

Current practice rule of thumb ECB (effective counterbalance)~Bouyant weight of rods+½ fluid load on pump plunger.

Lowest speed reducer 41 torque loads on walking beam 3 pumping units 37 occur at top and bottom of stroke, 0 degrees and 180 degrees, because of low torque factor from unit geometry. And nominal peak speed reducer torque loads occur at high torque factor at about 90 degrees and about 270 degree crank arm 18 angles which values are desired to be equal when the walking beam 3 pump is balanced in the field at the well using current practice in known systems.

Intentional negative torque 1 can be caused by deliberate unbalance using an end return 75 device for assisting a positioning drive 2 and moving beam counter weight force point 64 and is electrically regenerative and can assist a beam air compressor 31. Negative unbalance may occur when intentionally reducing torque 1, but negative unbalance above speed reducer 41 torque 1 rating can reach diminishing benefits so the recommended control parameters are to limit negative torque 1 to be within speed reducer 41 torque rating. Subsequent operating manuals can address details of these and other operational aspects, where:

Net torque (*Tn*)=9.53×kilowatt (kw)×efficiency (eff)/strokes per minute (SPM)×speed variation of power transmission (SV).

Torque factor (TF) is used to convert polished rod load to torque (Nm).

Torque due to net well load (*TWN*)=torque factor (TF)×well load (*WN*).

Net well load (*WN*)=well load (*W*)−unit unbalance (*SU*).

FIG. 1 illustrates an embodiment wherein well 11 is pumped by beam 3, which lifts load 9, which in this particular example is about 1.5 times greater when lifting than that of load 9 when it is being lowered. This is due to lifting the weight of the fluid plus the buoyant weight of the sucker rods in the pipe when lifting up, but that weight is then held by the well tubing in the downhole pump standing valve when being lowered. Thus, in known systems, the difference in load 9 is more or less split on the up stroke and down stroke which leaves a state of significant net torque 1 on prime mover 29 and net gear torque in in the speed reducer 41, due to the remaining unsolved unbalanced condition. Embodiments of the present invention reduce the problem of these high net torque 1 needed to lift and lower load 9 and crank arm 18 weight at effort force point 25 with a moving crank shaft force point 21 and moving effort force point 25 whose moving positions reduce torque factor and thus lifting and lowering net torque 1. In one embodiment, prime mover 29 can include but is not limited to an electric motor, an internal combustion engine, a hydraulic motor, combinations thereof and the like. Most preferably, the moving effort force point 25 is positioned substantially vertical to the crank pin 20. In these embodiments, moving force points on positioning drive 2 intelligently change position so the crank pin 20 maintains positioning substantially vertical with moving effort force point 25 where it can best cause the most reduction in net torque 1 that is required to lift and lower load 9 and/or crank weight load 10 at moving crank shaft force point 21. FIG. 1 to FIG. 6, in these embodiments, illustrate a class 1 lever having beam 3 that pumps with crank arm 18 and moving effort force point 25, moving crank shaft force point 21, and moving beam weight force point 64. FIG. 1 to FIG. 7 illustrate that of the many applications that embodiments of the present invention can apply to, we are now considering embodiments of the present invention as applied to class 1 lever—for example conventional crank weight pumping unit 37 as applied to a reciprocating beam pump, where circular motion is transferred from prime mover 29 to speed reducer 41 and then converted to linear motion with a pitman that is connected from crank pin 20 to moving effort force point 25 of beam 3 and net torque 1 is reduced by an end return 75 device for assisting positioning moving force points on positioning drive 2. Standard beam fixed weighted units in this description will not be drawn separately because they operate similar to conventional crank weight pumping unit 37. However an embodiment with a moving beam counterweight force point 64 that has a dual effect and also assists a beam air compressor is illustrated in FIG. 1.

When crank arms 18 are straight down at 180 degrees, which is the position of low torque factor, and an end return 75 device has assisted the moving crank shaft force point 21 and moving effort force point 25 are neutrally positioned near the middle of their range and wherein front end, i.e. the end nearest well 11 of beam 3 is as high as it will go at or about 180 degrees crank angle and is about to re-start the cycle of reciprocating downward. At that moment, moving crank shaft force point 21 and moving effort force point 25 begin moving away from near the middle of their range and are timed to maintain near verticality with the crank pin and arrive at the end of their range when crank arm 18 reaches near horizontal at 90 degrees or at 270 degrees to achieve maximum effective offset to the high torque factor in helping to rotate the crank weight. Then, crank arms 18 continue rotating and moving crank shaft force point 21 and moving effort force point 25 start moving back to neutral near the middle of their range, where they are preferably timed to arrive in neutral near the middle of their range when crank arms 18 are straight up or straight down at 180 degrees. The moving beam counterweight weight force point 64 is similarly positioned and equipped for maximum position efficiency by the end return device 75 assisting the positioning drive 2.

One method to calculate timing with position selection apparatus comprised of at least one of a vector logic circuit and a moving force point position circuit is: Distance from middle of moving range to front moving force point position/seconds elapse between 90 degree crank positions=feet per second (fps) moving force point speed.

Nominally, the distance from (middle of moving range of motion to rear moving force point position)/(seconds elapse between 90 degree crank positions)=feet per second moving force point travel speed.

Example: 10'/2 seconds=5 feet per second (fps) moving force point travel speed.

Embodiments of the moving force point positioning drive 2 can include, but are not limited to FIG. 2 a linear motor positioning drive 66 for control and speed; FIG. 6 a rack 51 and pinion 52 gear drive for heavy loads; FIG. 7 a motorized lead screw 46 bolt or ball screw 46 for moderate loads; FIG. 3 showing a single-acting or double-acting rodless cylinder 16 for low cost with precise control of lightish loads; other embodiments can be two opposing single acting rodless cylinders; tandem double-acting pneumatic cylinders for extended length; double-acting hydraulic cylinder with a hydraulic pump and return reservoir; also magnetic field propulsion; electro magnetism; an electric motor, a reciprocating electric motor; linear motor 66 or servo motor with encoder; cable pullers, chain pullers, and/or belt pullers, with a series of pulleys configured to actuate with beam 3; and other mechanical means consisting of gears, cables, chains, belts, and electric or magnetic drive.

FIG. 4, in one embodiment the end return 75 device assists the positioning drive 2 where movement of moving effort force point 25, moving crank shaft force point 21, and moving beam weight force point 64 is preferably caused by a double-acting pneumatic rodless cylinder in a cylinder positioning drive 16 when the weight is sufficiently light to enable pneumatic actuation. In one embodiment the end return 75 device assists the positioning drive 2 where a moving beam counterweight force point 64 allows use of crank arms 18 without supplemental crank arm weights 19. Sensors on cylinder positioning drive 16 can be magnetic to achieve spot positioning as cylinder passes or transducer type sensors for more continuous positioning signals. Pressure ports 33 with nomenclature like 4/2 and 5/2 on cylinder positioning drive 16 open and close as calculated and are instructed to actuate a cylinder of positioning drive 16 to move moving effort force point 25, moving crank shaft force point 21, and moving beam weight force point 64 into position as computed by programmable system logic controller 14. For example, the moment the rodless positioning element 6 passes by a magnetic sensor on the rodless piston carriage 5 a signal indicating that spot position can be sent to the programmable system logic controller 14. Or reaching the end of the range of motion can be sensed and it can then be programmed to reverse and return. Or adding transducers on the rodless piston carriage 5 can detect and measure variations in current and/or voltage which can be converted to signals that indicate the real time rodless pneumatic piston 16 position and speed in the carriage 5. Also speed control muffler, quick exhaust valves, needle valve and flow control fittings can control pneumatic speed. And potentiometer, hall effect sensor, motor controller, lead switch, and limit switch can be used for linear actuator and servo motor position control.

In one embodiment the end return 75 device assists the positioning drive 2 where moving force points movement on positioning drive 2 can be controlled by using basic reversal controls coordinated with beam position. In one embodiment, an apparatus and/or system to monitor movement and achieve position control of moving crank shaft force point 21, moving effort force point 25, moving beam weight force point 64 moving from at or near one or both ends of range of motion with end return 75 device assisting the positioning drive 2 can be accomplished by obtaining readings of power use by prime mover 29 by ammeter 17 sent to programmed system logic controller 14 to send signals in FIG. 3 to pressure ports 33 on a rodless cylinder of cylinder positioning drive 16 to which moving effort force point 25, moving crank shaft force point 21, and moving beam weight force point 64 is connected, for positioning moving crank shaft force point 21, moving effort force point 25, moving beam weight force point 64 to maintain ammeter 17 reading nearest to a low amperage reading throughout the complete reciprocating cycle.

In a redundant configuration, in one embodiment the end return 75 device assists the positioning drive 2 where an optimum position of moving force points on positioning drive 2 to achieve a reduction in torque factor and net torque 1 can be computed by programmed system logic controller 14 interpreting input data which can include from load cell 27 communicably coupled to load 9, an inclinometer 7 sensing angle of beam 3 and pitman arm 59, transducers 22 and magnets on prime mover 29, sensor 13 on the pumping unit structure sensing crank angle and strokes per minute, and/or signals from magnets or transducers on positioning drive 2. The signals from one or more sensors and load cell 27 are preferably interpreted by programmed system logic in controller 14 to compute optimum lowest value of at least one of the power required of a prime mover and the amount of net gear torque in in the speed reducer 41 by positioning moving effort force point 25, moving crank shaft force point 21, and moving beam weight force point 64, most preferably based on information from measurements, which can include, but is not limited to calculations using wave equation and inserted into a machine learning algorithm program.

One embodiment of the present invention the end return 75 device assists the positioning drive 2 where programmable system logic controller 14 processes the previously described measurements and provides them to a sending unit so that the machine learning algorithm communicates instructions to the drive mechanism to control the position of moving effort force point 25, moving crank shaft force point 21, and moving beam weight force point 64 continuously. In this embodiment, programmable system logic controller 14 can, for example, be programmed with the machine learning algorithm such that it will continually process new readings, parameters, and measurements and continually, in real time or near real time, send positioning instructions to positioning drive 2 to position moving effort force point 25, moving crank shaft force point 21, and moving beam weight force point 64 in order to reduce at least one of the power required of a prime mover and the amount of net gear torque 1 in in the speed reducer 41. These measurements can be based on the reduced effective amount of load 9 and effective crank weight load at moving effort force point 25, moving crank shaft force point 21, and moving beam weight force point 64. In one embodiment, a series of downhole measurements, including but not limited to those from load cell 27 on well 11, can be input into programmable system logic controller 14. Another input can optionally include a position of crank arm 18, which can optionally be obtained, at least in part, based on measurements from sensors 13, which can include magnetic transducers, on the pumping unit structure. Other inputs can optionally include the position of beam 3 and pitman arm 59 based on inclinometer 7; ampere measurements from ammeter 17, for embodiments wherein prime mover 29 comprises an electric motor; from vacuum readings for embodiments wherein prime mover 29 comprises an internal combustion engine; and/or one or more measurements stored in memory module 12 for programmable logic controller 14. In one embodiment, display 15 is preferably provided and can be operatively connected to memory module 12 and/or programmable system logic controller 14 for displaying a series of measurements stored in memory module 12 for system logic controller 14, and/or for displaying indicia of one or more values from any other sensor or combinations of sensors used.

In one embodiment, machine learning algorithm can be processed using system controller 30. System controller 30 preferably sends positioning instructions to positioning drive 2 most preferably in real time or near real time. In one embodiment the end return 75 device assists the positioning drive 2 where processed instructions to positioning drive 2 selectively positions moving effort force point 25, moving crank shaft force point 21, and moving beam weight force point 64 so that the position of moving effort force point 25, moving crank shaft force point 21, and moving beam weight force point 64 causes reduced torque factor and net torque 1 as the result of reduced effective load 9 and then also reduced effective crank weight load 10 at moving effort force point 25, moving crank shaft force point 21, and moving beam weight force point 64. System controller 30 preferably includes a programmable system logic controller 14 that is most preferably programmed with a machine learning algorithm and allows the continuous processing of new readings, parameters, and measurements. System controller 30 also preferably includes a sending unit that communicates the processed data to a positioning selection mechanism that is preferably communicably coupled to positioning drive 2, which positions moving effort force point 25 and moving crank shaft force point 21 in accordance with the instructions to maintain verticality with the crank pin 20.

In one embodiment, the machine learning algorithm can be processed by system controller 30 with an input for a series of downhole measurements. These inputs can include but are not limited to inputs from load cell 27 on well 11; crank arm 18 position measurements—for example from magnets with sensors 13 mounted on the pumping unit structure; position of beam 3 from inclinometer 7; ampere measurements from ammeter 17, for embodiments wherein prime mover 29 is an electric motor, and/or vacuum readings for embodiments wherein prime mover 29 is an internal combustion engine.

In one embodiment, the machine learning algorithm can be processed by a measurement input that can store a series of measurements in memory module 12 for programmable system logic controller 14.

In one embodiment, system controller 30 can process the series of measurements stored in memory module 12 for system logic controller 14 with a machine learning algorithm such that display 15 is operatively connected to the system controller with memory module 12 and programmable system logic controller 14.

The rotational motion of crank arms 18 cause a maximum moment of rotary crank arm 18 weight, crank shaft 21 and crank pins 20 about moving crank shaft force point 21 in inch-pounds, which is nominally the maximum effective moving crank shaft force point 21 counterbalance at about 90 degrees or in FIG. 4 at about 270 degrees. At about 90 degrees or at about 270 degrees is nominally the position of maximum torque and effective counterbalance. So when the programmed logic commands the position of moving crank shaft force point 21 to be positioned to maintain the verticality of the crank pin 20 with effort force point 25, it is lowering torque factor and increasing effective crank counterweight 10 to offset the maximum amount of net torque 1 in the horizontal position to raise load 9, and, vice versa when commanded to maintain verticality of the crank pin 20 with effort force point 25 to raise the effective crank weight 10. The moving effort force point 25 and moving beam counterweight weight force point 64 are likewise timed for maximum efficient placement by the positioning drive 2.

Lowest speed reducer 41 net torque 1 loads on reciprocating beam 3 pumping units 37 occur at top and bottom of stroke, at 0 degrees and 180 degrees, because of low torque factor from unit geometry. And with the current art nominal peak net torque 1 loads on speed reducer 41 occur at high torque factor at 90 degrees crank arm 18 angles and at 270 degrees crank arm 18 angles which are substantially equally high torque values when reciprocal beam 3 pump is operated normally in the current art. Embodiments of the present invention can achieve reduced net torque 1 at 90 degrees crank arm 18 angles and at 270 degrees crank arm 18 angles because of lower torque factor.

The following equations further describe an embodiment of the present invention:

Net torque ($Tn$)=9.53×kilowatt (kw)×efficiency (eff)/strokes per minute (SPM)×speed variation of power transmission (SV).

Torque factor (TF) is used to convert polished rod load to torque (Nm).

Torque due to net load ($TWN$)=torque factor (TF)×load ($N$).

Net load ($N$)=load ($W$)−unit unbalance ($SU$).

In one embodiment, consider:

Pressure ($P$)=Force ($F$)/Area ($A$).

Force ($F$)=Pressure ($P$)×Area ($A$).

Load×Distance from tipping point=Counterweight Mass×Distance from tipping point and is called load moment.

A "Rule of thumb" for top of the head calculation in the field:

ECB (effective counterbalance)~Buoyant weight of rods+½ fluid load on pump plunger.

The "Permissible Load" is the polished rod load necessary to give a resultant net torque equal to the API rating of the reducer with a certain amount of counterbalance. This load should be calculated for each 15 degree crank position. The formula used for this calculation is:

$$W(\text{Permissible Load}) = \frac{\text{Net Torque} - M\ \text{Cos}\,\theta}{TF}$$

where:

Net Torque=API rating of the gear reducer

M=Counterbalance torque at 90° (FIG. 2) or 270° (FIG. 4)(Determined by counterbalance requirements for a particular pumping application)

θ=Crank Angle

W=Permissible Load (Polished rod load required to give net torque equal to rating of the gear reducer)

Net torque for a pumping unit is calculated by the following API formula:

$$\text{Net Torque}=(\text{TF})(W)-(M\ \text{Cos}\ \theta)$$

where:

TF=Torque Factor

W=Polished Rod Load

M=Counterbalance Torque at 90° (FIG. 2) or 270° FIG. 4)

θ=Angle of crank, starting with 0° at vertical position and reading clockwise.

Net torque can be found by this formula when polished rod load, counterbalance torque and crank angle are known. The formula is used to find net torque from dynamometer cards.

The foregoing embodiments have been presented for the purposes of illustration and description. They are not intended to be exhaustive or to limit the invention and method of use to the precise forms disclosed. The embodiments have been chosen and described in order to best explain the principles and practical application in accordance with the invention to enable those skilled in the art to best utilize the various embodiments with expected modifications as are suited to the particular use contemplated. The present application includes such modifications and is limited only by the scope of the claims. Although the foregoing discussion describes the most preferred locations of moving effort force point 25, moving crank shaft force point 21, and moving beam weight force point 64 at various times in the pumping cycle, it is important to understand that such preferred locations are merely described for illustration purposes and desirable results can be achieved when moving effort force point 25, moving crank shaft force point 21, and moving beam weight force point 64 is in approximately such locations.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A well pump, comprising:

a walking beam;

a pair of end return devices, a first one of the end return devices disposed at a first end of the walking beam, a second one of the end return devices disposed at a second opposite end of the walking beam; and a propulsion device disposed on the walking beam, the propulsion device configured for lateral movement along a length of the walking beam;

wherein lateral movement of the propulsion device along the length of the walking beam laterally moves: (1) an effort force point disposed on a tail bearing of the well pump; (2) a crank shaft force point connected with a crank pin of a speed reducer disposed on the well pump; and (3) a force point of a counterweight disposed on the walking beam and configured for lateral movement along the length of the walking beam;

wherein the effort force point, the crank shaft force point, and the force point of the counterweight are arranged in a structural vertical relationship on the well pump to thereby reduce an amount of torque required by the well pump for its pumping operations; and wherein each one of end return devices is configured to perform at least one of: (1) initiate forward lateral movement of the propulsion device along the length of the walking beam; (2) initiate reverse lateral movement of the propulsion device along the length of the walking beam; (3) decelerate lateral movement of the propulsion device along the length of the walking beam; or (4) stop lateral movement of the propulsion device along the length of the walking beam.

2. The well pump of claim 1, wherein the propulsion device includes a permanent magnet, and wherein each one of the end return devices is configured to change a direction of the lateral movement of the propulsion device along the length of the walking beam by applying magnetic force or magnetic resistance to the permanent magnet.

3. The well pump of claim 1, wherein the propulsion device comprises a linear motor.

4. The well pump of claim 1, wherein each one of the end return devices is configured to change a direction of the lateral movement of the propulsion device along the length of the walking beam by applying to the propulsion device one of a spring force, a hydraulic force, a pneumatic force, an elastic force, or a regenerative force.

5. The well pump of claim 1, wherein each one of the end return devices is configured to adjust the torque factor of a speed reducer crank arm.

6. The well pump of claim 1, wherein the well pump comprises one of a class 1 level geometry, a class 2 lever geometry, or a class 3 lever geometry.

7. A well pump, comprising:

a walking beam;

a pair of end return devices, a first one of the end return devices disposed at a first end of the walking beam, a second one of the end return devices disposed at a second opposite end of the walking beam; and a propulsion device disposed on the walking beam, the propulsion device configured for lateral movement along a length of the walking beam;

wherein each one of the end return devices comprises:

means for one or more of starting and stopping lateral movement of the propulsion device along the length of the walking beam; and means for one or more of push starting and braking and stopping lateral movement of the propulsion device along the length of the walking beam; and wherein the propulsion device is configured to laterally move: (1) an effort force point disposed on a tail bearing of the well pump; (2) a crank shaft force point connected with a crank pin of a speed reducer disposed on the well pump; and (3) a force point of a counterweight disposed on the walking beam; and wherein the effort force point, the crank shaft force point, and the force point of the counterweight are arranged in a structural vertical relationship on the well pump to thereby reduce an amount of torque required by the well pump for its pumping operations.

8. The well pump of claim 7, further comprising:

means for utilizing each one of the end return devices with class 1 lever geometry;

means for utilizing each one of the end return devices with class 2 lever geometry; and means for utilizing each one of the end return devices with class 3 lever geometry.

9. The well pump of claim 7, wherein the force propulsion device comprises a permanent magnet, and wherein each one of the end return devices further comprises one or more of:

means for urging the permanent magnet for lateral movement along the length of the walking beam;

means for reversing lateral movement of the permanent magnet along the length of the walking beam;

means for decelerating lateral movement of the permanent magnet along the length of the walking beam; and means for accelerating lateral movement of the permanent magnet along the length of the walking beam.

10. The well pump of claim 7, wherein each one of the end return devices further comprises at least one of:

means for propelling and push starting a permanent magnet for movement along the length of the walking beam;

means for halting and stopping movement of the permanent magnet along the length of the walking beam;

means for propelling and push starting a linear motor for movement along the length of the walking beam;

means for halting and stopping movement of the linear motor along the length of the walking beam;

means for propelling and push starting the propulsion device for movement along a length of the walking beam; and means for halting and stopping movement of the propulsion device along the length of the walking beam.

11. The well pump of claim 7, wherein each one of the end return devices further comprises one or more of:

a spring absorber, a spring cushioner, a spring repeller, a spring push starter, a hydraulic absorber, a hydraulic cushioner, a hydraulic repeller, a hydraulic push starter, a pneumatic absorber, a pneumatic cushioner, a pneumatic repeller, a pneumatic push starter, a magnetic absorber, a magnetic cushioner, a magnetic repeller, a magnetic push starter, an elastomer absorber, an elastomer cushioner, an elastomer repeller, an elastomer push starter, an eddy current brake, an eddy current cushioner, an eddy current push starter, and a regenerative brake.

12. The well pump of claim 7, wherein each one of the end return devices further comprises one or more of:

means for adjusting one or more of force and strength whereby torque is reduced;

means for adjusting one or more of position and placement whereby torque is reduced; and means for adjusting one or more of speed and velocity whereby torque is reduced.

* * * * *